US011273959B2

(12) United States Patent
Russell et al.

(10) Patent No.: US 11,273,959 B2
(45) **Date of Patent: *Mar. 15, 2022**

(54) CONTAINER WITH LID AND DETACHABLE LID COLLAR

(71) Applicant: Berry Plastics Corporation, Evansville, IN (US)

(72) Inventors: Mark N. Russell, Boonville, IN (US); Daniel A. Bloom, Evansville, IN (US); Scott L. Fisher, Evansville, IN (US); Jason A. Rowe, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/083,733

(22) Filed: Oct. 29, 2020

(65) Prior Publication Data

US 2021/0039839 A1 Feb. 11, 2021

Related U.S. Application Data

(63) Continuation of application No. 15/887,419, filed on Feb. 2, 2018, now Pat. No. 10,889,411.
(Continued)

(51) Int. Cl.
*B65D 41/34* (2006.01)
*B65D 43/02* (2006.01)
*B65D 1/26* (2006.01)

(52) U.S. Cl.
CPC ..... *B65D 41/3442* (2013.01); *B65D 1/265* (2013.01); *B65D 43/0283* (2013.01);
(Continued)

(58) Field of Classification Search
CPC ..... B65D 41/3442; B65D 1/265; B65D 43/0283; B65D 2401/35; B65D 2543/00092; B65D 2543/00537
USPC ..... 220/288, 710.5, 717, 711, 713, 740; 215/11.1, 367, 388, DIG. 7; 229/404, 229/906.1; 222/570; D7/531
See application file for complete search history.

(56) References Cited

U.S. PATENT DOCUMENTS

D42,683 S * 7/1912 Anderson ..... A47G 19/2205 D7/531
D43,703 S * 3/1913 Sanford ..... H05B 6/103 D7/531
(Continued)

FOREIGN PATENT DOCUMENTS

AT 325522 T 6/2006
AT 171650 7/2010
(Continued)

OTHER PUBLICATIONS

Office Action dated May 29, 2020 for U.S. Appl. No. 15/887,419 (pp. 1-12).

*Primary Examiner* — Chun Hoi Cheung
*Assistant Examiner* — Brijesh V. Patel
(74) *Attorney, Agent, or Firm* — Barnes & Thornburg LLP

(57) ABSTRACT

A package includes a container formed to include a product-storage region and a mouth arranged to open into the product-storage region and a closure configured to mate with the container and establish a closed arrangement of the package and to be separated from the package at the option of a user to establish an opened arrangement.

20 Claims, 7 Drawing Sheets

Related U.S. Application Data

(60) Provisional application No. 62/454,402, filed on Feb. 3, 2017.

(52) U.S. Cl.
CPC ..... *B65D 2401/35* (2020.05); *B65D 2543/00092* (2013.01); *B65D 2543/00537* (2013.01)

(56) References Cited

U.S. PATENT DOCUMENTS 1,595,040 A * 8/1926 Voss ..... B65D 1/06 215/382
2,299,730 A * 10/1942 Bornstein ..... A47G 19/2216 220/718
3,403,803 A * 10/1968 Markowitz ..... B65D 50/04 215/218
3,563,408 A * 2/1971 Bijvoet ..... B21D 51/2646 220/671
3,787,547 A * 1/1974 Stephan ..... B29C 49/0073 264/249
3,858,741 A * 1/1975 Smith, Sr. ..... B65D 50/046 215/216
4,109,815 A * 8/1978 Collins, III ..... B65D 43/0212 215/232
4,180,961 A * 1/1980 Collins, III ..... B65D 43/0212 53/421
4,237,360 A * 12/1980 Pohlenz ..... B29C 66/82263 219/604
4,254,882 A * 3/1981 Yoshino ..... B65D 1/0284 215/375
D284,923 S * 8/1986 Ritman ..... B32B 5/32 D7/531
4,697,719 A * 10/1987 Allen ..... B65D 43/0212 215/232
4,964,205 A * 10/1990 Coffman ..... B29C 51/12 264/512
5,024,341 A * 6/1991 Dekerle ..... A61J 11/045 215/11.1
5,033,232 A * 7/1991 Vaughn ..... A47G 7/08 47/72
D343,091 S * 1/1994 Shafer ..... A47G 19/2272 D7/523
D350,406 S * 9/1994 Gereau ..... B65D 1/0207 D26/6
5,614,148 A 3/1997 Beck
5,657,889 A * 8/1997 Guglielmini ..... B65D 41/3428 215/252
5,712,042 A * 1/1998 Cain ..... B32B 15/04 428/458
5,714,111 A 2/1998 Beck
D391,493 S * 3/1998 Panella ..... B65D 47/088 D9/538
5,738,921 A * 4/1998 Andersen ..... B28B 11/003 428/36.4
5,884,786 A * 3/1999 Valyi ..... B29C 49/20 215/44
5,913,438 A * 6/1999 Beck ..... B29C 49/0073 215/375
D428,307 S * 7/2000 Yeandel ..... D7/523
6,082,566 A * 7/2000 Yousif ..... B32B 15/08 215/232
6,100,277 A 8/2000 Tucker
6,105,807 A * 8/2000 McCrossen ..... B65D 79/005 220/288
6,277,478 B1 * 8/2001 Kurita ..... B65D 51/20 428/200
6,649,022 B2 * 11/2003 Hammen ..... H05B 6/103 156/380.2
6,779,677 B2 * 8/2004 Chupak ..... B65D 1/0207 215/335
7,004,341 B2 * 2/2006 Shenkar ..... B65D 51/145 215/256
7,119,310 B2 * 10/2006 Hammen ..... B29C 65/3656 219/632
D534,768 S * 1/2007 Mansfield ..... B65D 53/04 D7/513
D556,512 S * 12/2007 Mansfield ..... B65D 51/145 D7/509
7,780,024 B1 * 8/2010 Marsella ..... B65D 53/04 215/350
7,850,033 B2 * 12/2010 Thorstensen-Woll ..... B65D 53/02 220/359.3
8,100,277 B1 * 1/2012 Bush ..... B65D 77/2024 215/305
8,152,018 B2 * 4/2012 Smith ..... B65D 1/46 220/675
8,308,003 B2 * 11/2012 O'Brien ..... B32B 5/32 215/232
8,833,559 B2 9/2014 Scott
8,875,920 B2 * 11/2014 Farrar ..... B65D 41/08 215/329
9,282,837 B2 * 3/2016 Scott ..... B65D 77/00
2003/0019364 A1 * 1/2003 Garvin ..... A47G 19/2205 99/275
2003/0062130 A1 * 4/2003 Hammen ..... H05B 6/103 156/380.6
2003/0127419 A1 * 7/2003 Shenkar ..... B65D 51/145 215/256
2003/0192891 A1 * 10/2003 Ziegler ..... A47G 19/2272 220/288
2004/0234713 A1 * 11/2004 Celerier ..... B32B 7/12 428/35.7
2005/0224184 A1 * 10/2005 Hammen ..... B29C 66/542 156/379.6
2007/0108156 A1 * 5/2007 Durand ..... B65D 1/0223 215/375
2007/0294983 A1 12/2007 Carvin
2008/0044603 A1 * 2/2008 Hutchinson ..... B65D 51/20 428/35.7
2008/0121605 A1 5/2008 Thorstensen-Woll
2010/0092623 A1 4/2010 Carvin
2010/0193463 A1 8/2010 O'Brien
2011/0127232 A1 * 6/2011 Willows ..... B65D 47/088 215/354
2013/0313220 A1 11/2013 Scott
2014/0084001 A1 * 3/2014 Gerson ..... B05B 7/2405 220/212
2014/0374374 A1 12/2014 Scott
2016/0150900 A1 * 6/2016 Scott ..... A47G 19/2255 206/459.5
2016/0167823 A1 * 6/2016 Gutekunst ..... A47G 19/2255 206/459.5
2017/0042355 A1 * 2/2017 Bolland ..... A47G 19/2205

FOREIGN PATENT DOCUMENTS

| | | |
|---|---|---|
| AU | 2003230859 | 10/2003 |
| DE | 50211188 | 2/2007 |
| DE | 50333003 | 7/2010 |
| EP | 1433362 | 6/2004 |
| EP | 1495656 | 1/2005 |
| GB | 200814459 | 9/2008 |
| WO | 200330590 | 5/2003 |
| WO | 200388717 | 10/2003 |

* cited by examiner

CONTAINER WITH LID AND DETACHABLE LID COLLAR

PRIORITY CLAIM

This application is a Continuation of U.S. Non-Provisional application Ser. No. 15/887,419, filed Feb. 2, 2018, which claims priority under 35 U.S.C. § 119(e) to U.S. Provisional Application Ser. No. 62/454,402, filed Feb. 3, 2017, each of which is expressly incorporated by reference herein.

BACKGROUND

The present disclosure relates to a container, and to a lidded container. More particularly, the present disclosure relates to a lidded container suitable for containing carbonated or pressurized contents.

SUMMARY

According to the present disclosure, a package includes a container and a closure. The container is formed to include a product-storage region and a mouth opening into the product-storage region. The closure may be installed on the container to close the mouth or separated from the container to open the mouth and allow access to products stored in the product-storage region.

In illustrative embodiments, the closure includes a lid and a lid collar. The lid is coupled to the lid collar to close the mouth when the container is in a closed position. The lid is separated from the lid collar to open the mouth when the container is in an opened position.

In illustrative embodiments, the lid collar further includes a bottom ring, a container mount coupled to the bottom ring, and a lid mount coupled to the bottom ring. The lid mount includes a collar facet. The container mount includes a container facet. When the container is in a closed position, the container facet and the collar facet are coupled to block rotational movement of the lid collar when the lid is rotated.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
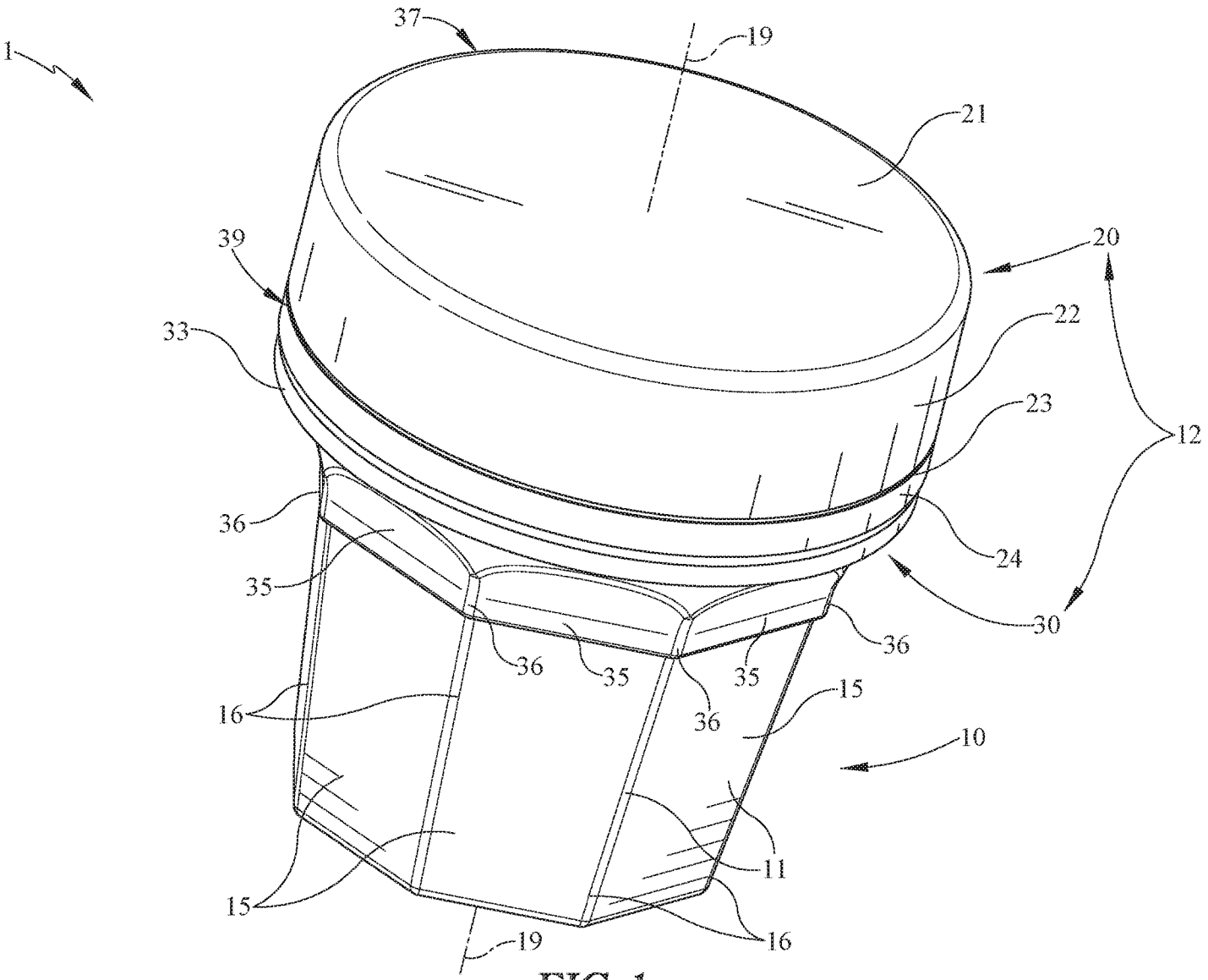
FIG. 1 is a perspective view of a first embodiment of a package in accordance with the present disclosure.

A package 1 in accordance with the present disclosure may be used to store products therein. Package 1 includes, for example, a container 10 and a closure 12 as shown in FIG. 1. In one example of use, package 1 may be used to store a beverage in a product-storage region 17 formed in container 10. A user may access and drink the beverage by opening package 1 and separating closure 12 from container 10 to expose a mouth 18 formed in the container 10 which is arranged to open into product-storage region 17. Closure 12 is coupled selectively to container 10 to close the mouth 18 and block the beverage or other contents from moving out of product-storage region 17.

Closure 12 includes lid 20 and a lid collar 30 as shown in FIGS. 1 and 3-5. Lid collar 30 is coupled to a top portion of container 10 and configured to couple selectively with lid 20. Once lid 20 is separated from lid collar 30, lid collar 30 may be slid away from container 10 leaving container 10 and the contents stored in product-storage region 17.

Figure 3:
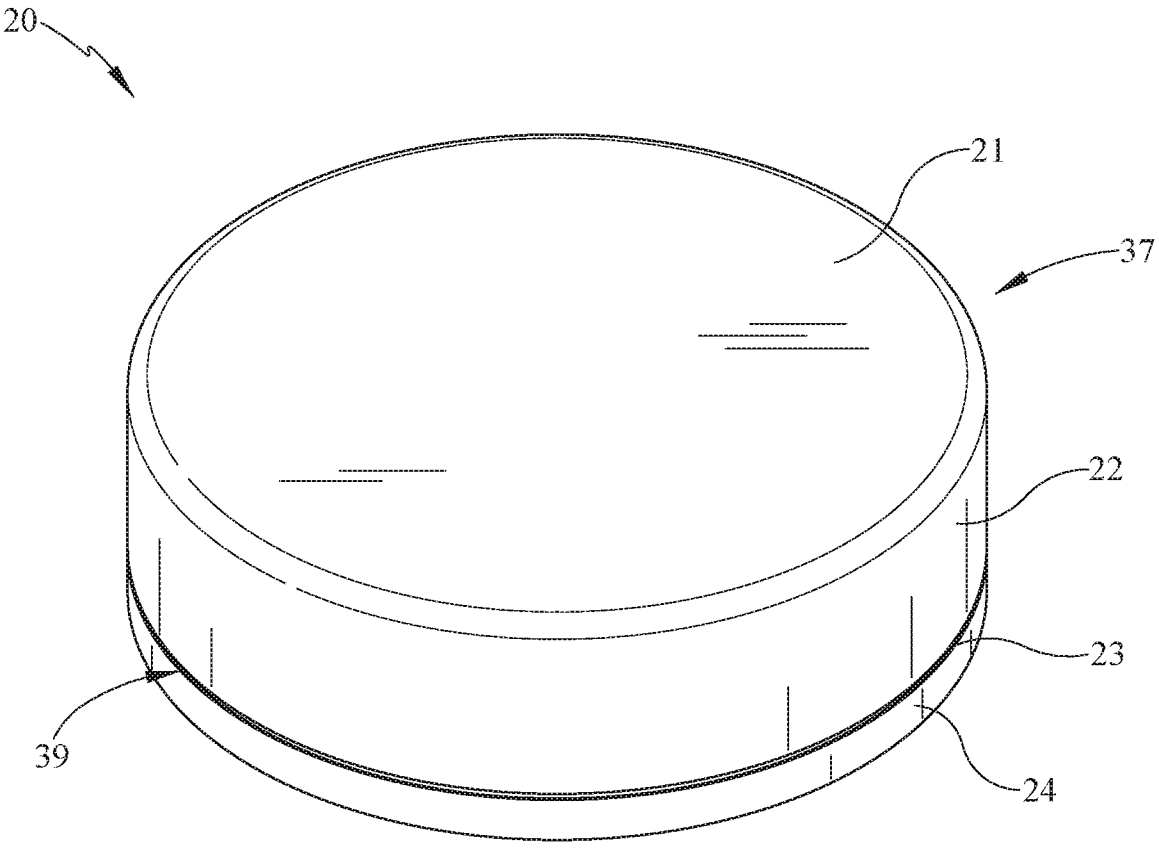
FIG. 3 is a top perspective view of a closure included in the package of FIG. 1.
Figure 4:
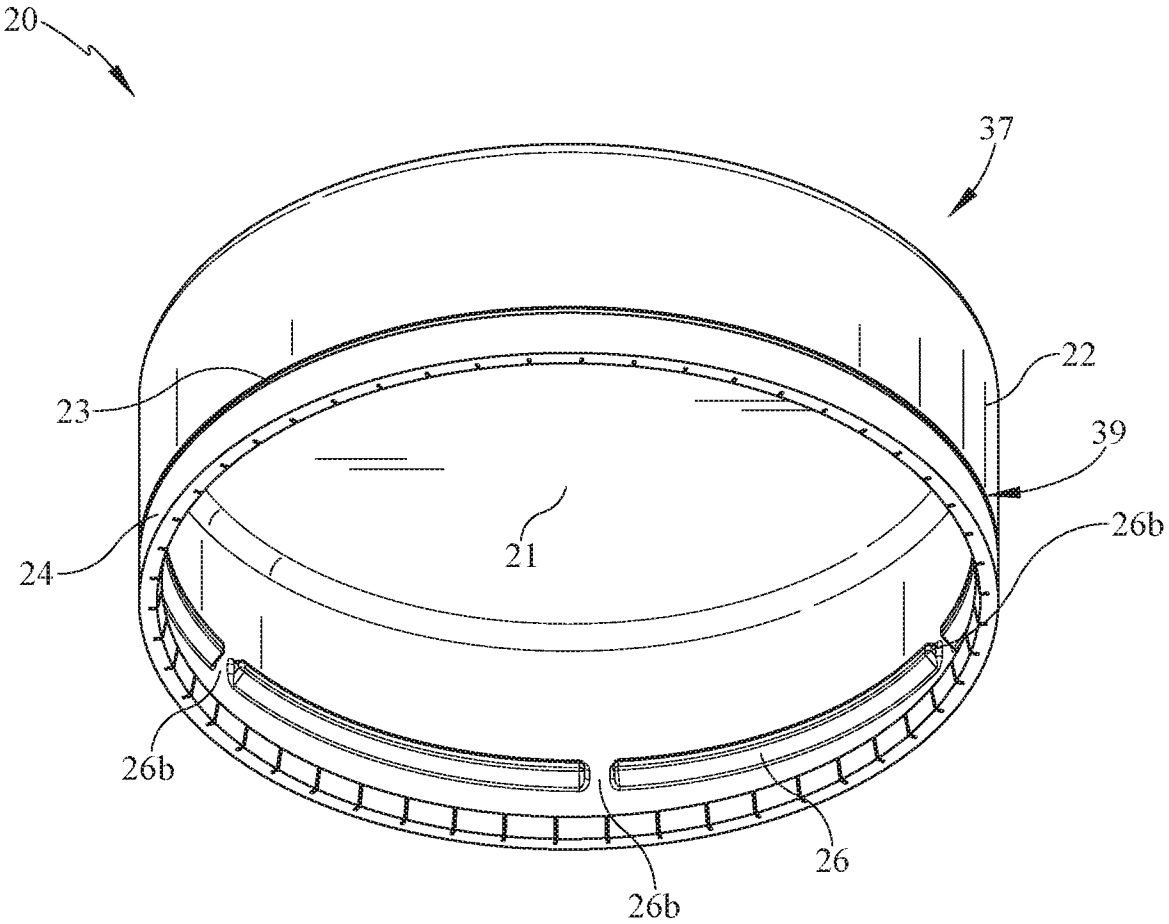
FIG. 4 is a bottom perspective view of the closure of FIG. 3.

Lid 20 includes a top wall 21, a skirt 22 arranged to extend downwardly from top wall 21, a band 24, a break area 23, and a lid thread 26 as shown in FIGS. 3 and 4. In some examples, top wall 21 may be configured to substantially cover the opening to product-storage region 17 of container 10 formed by container rim 13. Skirt 22 may be used to provide support and/or locate other features of lid 20. Band 24 may be provided to facilitate coupling, attaching, and/or coupling lid 20 to container 10 and lid collar 30. Break area 23 may be provided facilitate separation of band 24 from skirt 22. For example, band 24 may be removable from skirt 22 to provide a visual indicator that lid 20 has been opened or removed from container 10 thereby allowing potential access to products stored in product-storage region 17. The absence of band 24 may communicate to a user that package 1 has been opened and/or tampered with.

Figure 5:
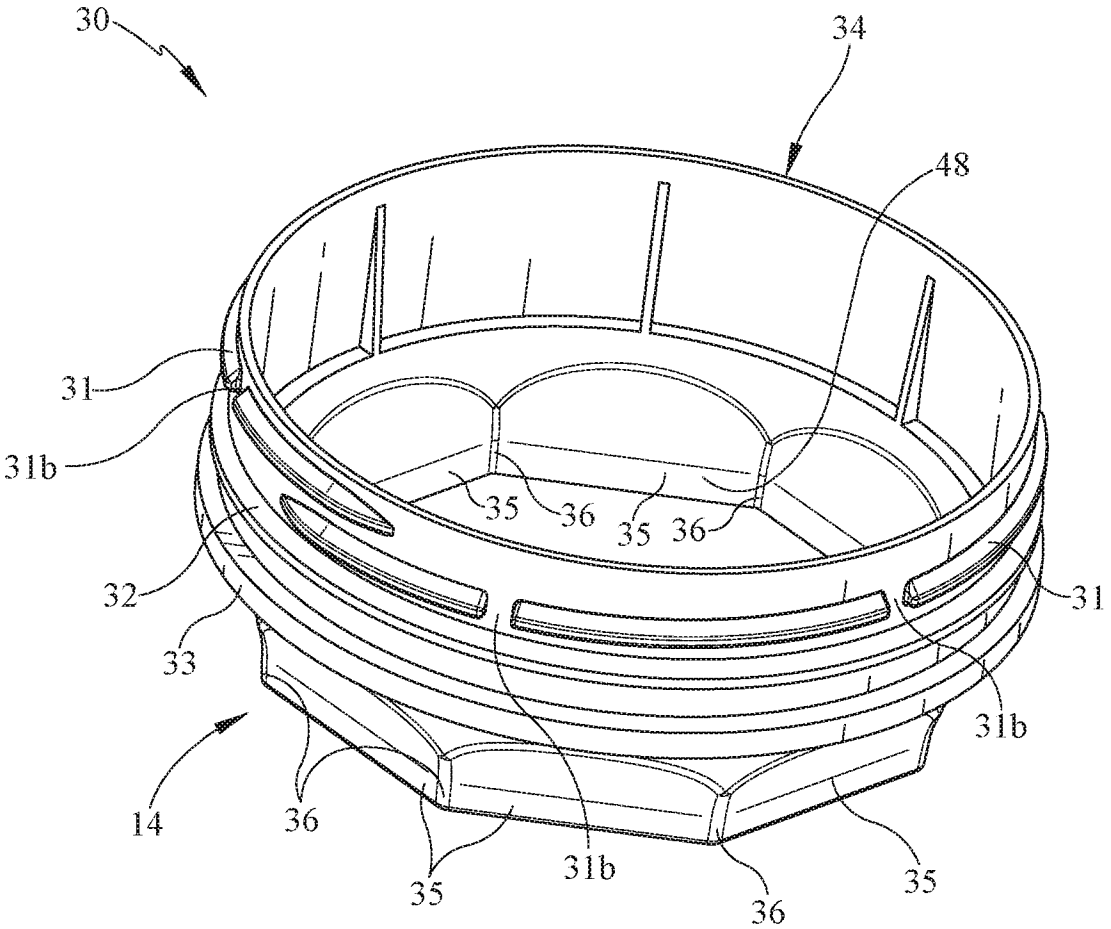
FIG. 5 is a perspective view of a lid collar included in the closure of FIG. 1.
Figure 7:
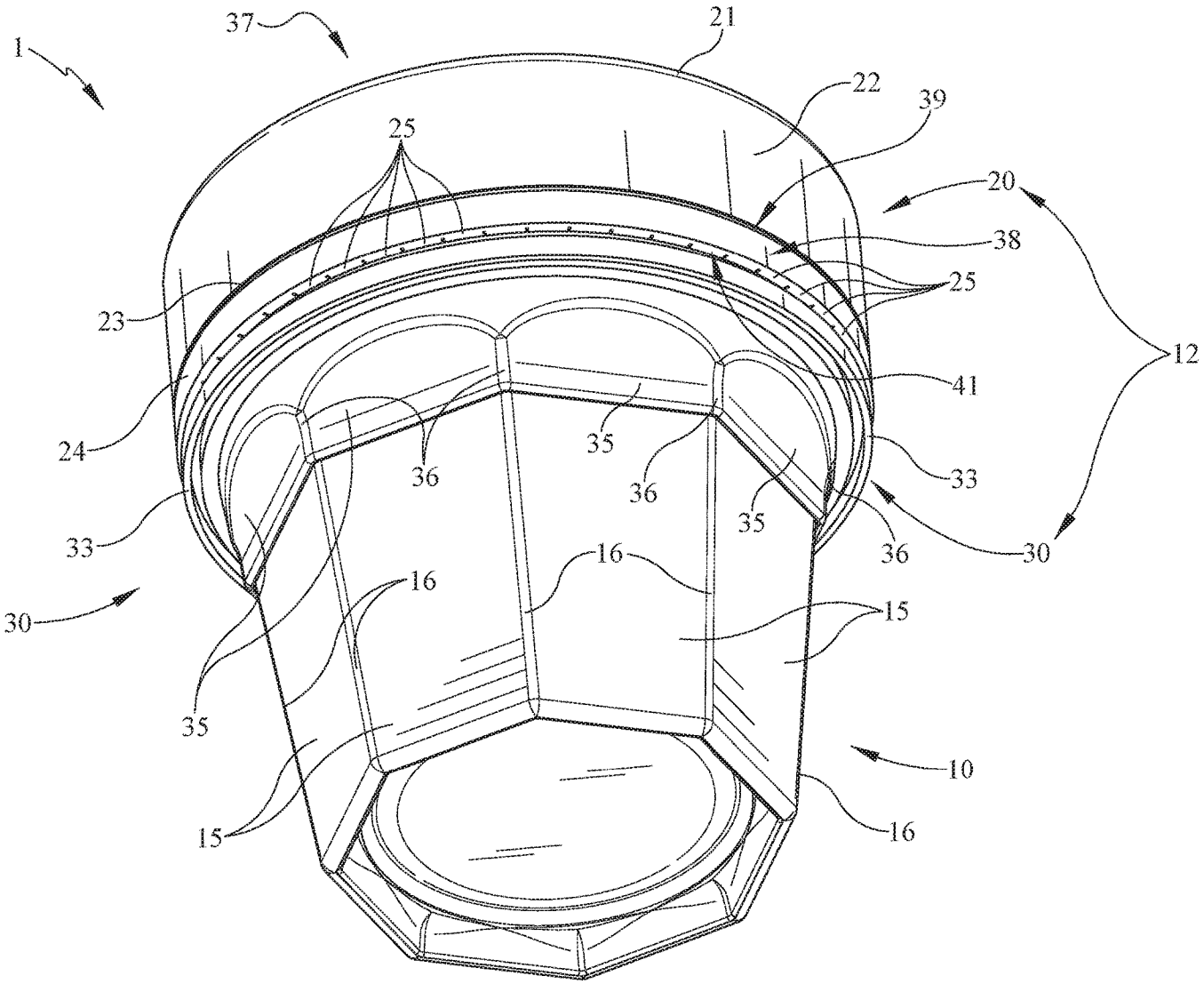
FIG. 7 is a bottom perspective view of the package of FIG. 1.

Band 24 may further include one or more protrusions 25 for engaging lid collar 30 and/or container 10, and/or a component thereof as shown in FIG. 7. Protrusions 25 may include an inwardly and downwardly angled surface 27 and/or a substantially horizontal or flat upper surface 28. Protrusions 25 facilitate a push on or snap on engagement of lid 20. For example, as lid 20 is pushed down, screwed on, or otherwise caused to move downwardly relative to container rim 13, protrusions 25 may engage gradually a collar ring 32, as shown in FIG. 5, via respective angled surfaces 27 until eventually snapping or locking into place when upper surfaces 28 reach the bottom of collar ring 32. This procedure and/or mechanism may be used, for example, after filling container 10 with contents such as a beverage at a filling facility, and lidding container 10 with closure 12.

Package 1 may be subsequently opened by removing closure 12. If band 24 and/or protrusions 25 are included, opening of package 1 by removing closure 12, for example, by unscrewing lid 20 relative to container 10, may cause protrusions 25 and/or respective upper surfaces 28 to engage collar ring 32, thereby blocking band 24 from moving upwardly relative to container 10 and lid collar 30. This may cause separation of band 24 from skirt 22. Break area 23 may be provided to facilitate such separation, for example, by comprising an area of reduced strength relative to skirt 22 band 24 such as might be formed by use of thinner material, perforations, score lines, etc. The separation of band 24 from skirt 22 and/or the breakage, rupturing, or discontinuity formed in break area 23 could provide a readily apparent indicator, visual or otherwise, to a consumer to signal that package 1 had been opened previously.

Figure 2:
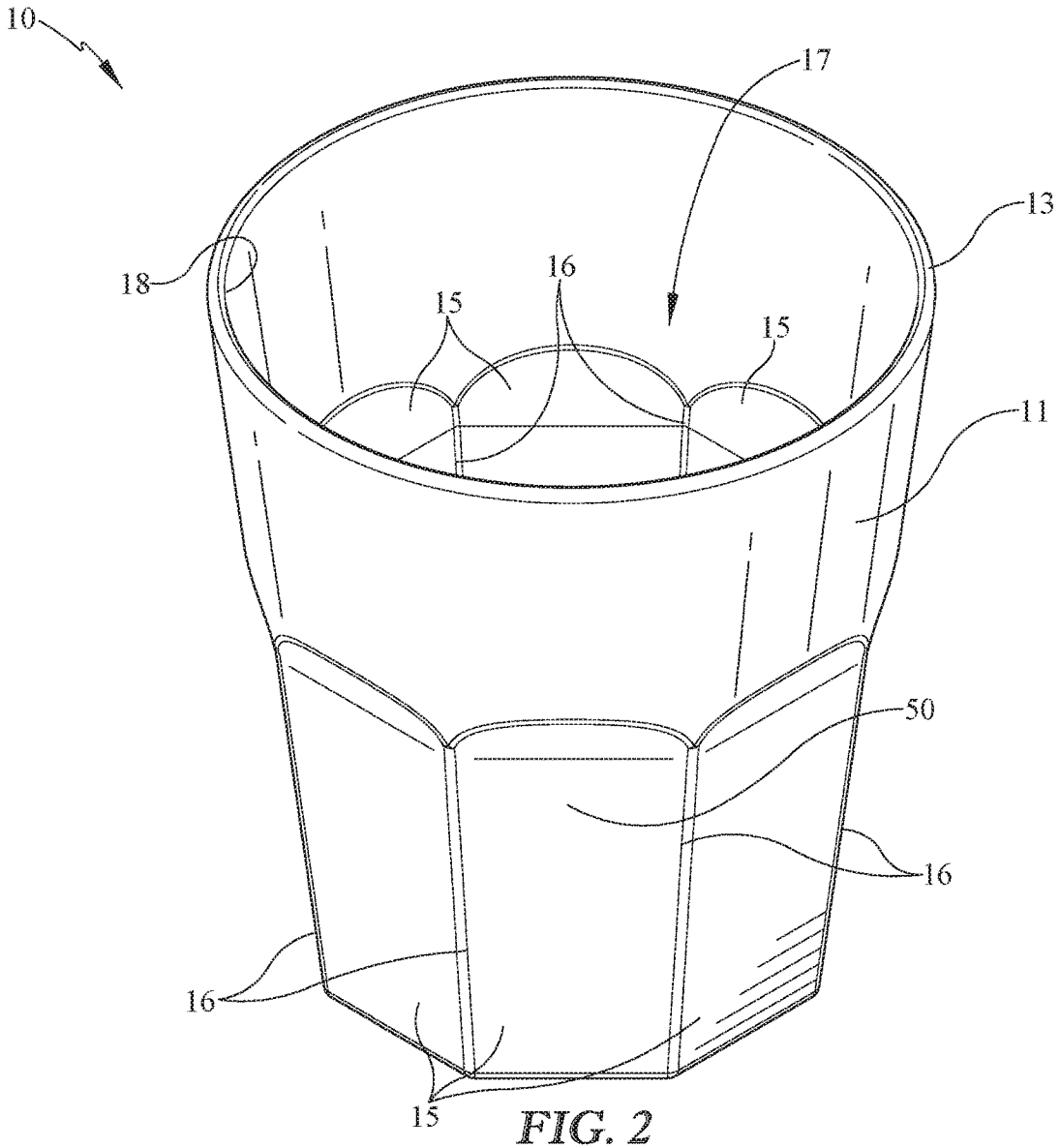
FIG. 2 is a perspective view of a container included in the package of FIG. 1.

Container 10 is shown, for example, in FIG. 2. Container 10 may be formed as desired, and in some embodiments may be formed as a typical or stylized cup, glass, tumbler, etc. For example, container 10 may be formed in the style of a cocktail glass, which may give the feeling, appearance, and/or impression of a quality that is higher than what is generally associated with a disposable container. Container 10 may also give the impression of being made from a glass material rather than a plastic material, for example. To aid in such an appearance or to enhance it, container wall 11 of container 10 may be formed to have a relatively smooth outer portion in an area proximate container rim 13. Moreover, in addition to providing a smooth visual appearance, a smooth area of container wall 11 proximate container rim 13 may provide a better or more desirable feel to a consumer who is consuming and/or drinking from container 10. However, such a smooth area may make it more difficult to fasten lid 20 to container 10 when providing a threaded area or snap features on container wall 11. For this or any other reason, lid collar 30 may be included to couple container 10 and lid 20. In some embodiments, lid collar 30 may be configured such that it may be removed from container 10 and/or discarded after package 1 is opened.

Lid 20 includes, for example, a thread configuration as shown in FIGS. 4 and 5. Lid 20 may, for example, include a lid thread 26 for engaging a collar thread 31 included in lid collar 30. Such a configuration may provide for axial movement of lid 20 relative to lid collar 30 by rotating lid 20 relative to lid collar 30. Package 1 may be used to store pressurized contents of any sort, including but not limited to a carbonated beverage. If so, the pressure inside package 1 may be greater than external pressure.

In one example of use, the contents stored in product-storage region 17 of container 10 may include $CO_2$ gas. The $CO_2$ may be up to approximately three $CO_2$ gas volumes. In some embodiments the contents of package 1 may be up to about five $CO_2$ gas volumes. In some embodiments the contents of package 1 may be up to about six $CO_2$ gas volumes. In some embodiments the contents of package 1 may be up to approximately 2.5 $CO_2$ gas volumes. In some embodiments the contents of package 1 may be up to approximately two $CO_2$ gas volumes. In an exemplary embodiment, used only as a non-limiting example, at an ambient temperature of about 70 degrees Fahrenheit, with the contents of package 1 sealed from the outside environment, the pressure may be about 28-30 psi and in at least one case was measured at 28.6 psi. The pressure may fluctuate with temperature so that, continuing the example, at an ambient temperature of about 100 degrees Fahrenheit, the pressure may be about 51.3 psi.

The pressure inside package 1 may be up to approximately 200 psi in some embodiments. The pressure inside package 1 may be up to approximately 150 psi in some embodiments. The pressure inside package 1 may be up to approximately 100 psi in some embodiments. The pressure inside package 1 may be up to approximately 90 psi in some embodiments. The pressure inside package 1 may be up to approximately 75 psi in some embodiments. The pressure inside package 1 may be up to approximately 70 psi in some embodiments. The pressure inside package 1 may be up to approximately 60 psi in some embodiments. The pressure inside package 1 may be up to approximately 50 psi in some embodiments. The pressure inside package 1 may be up to approximately 40 psi in some embodiments. The pressure inside package 1 may be up to approximately 20 psi in some embodiments. The pressure inside package 1 may be up to approximately 10 psi in some embodiments.

In some embodiments, the pressure inside package 1 may be approximately equivalent to one atmosphere. In some embodiments, the pressure inside package 1 may be greater than approximately 10 psi. In some embodiments, the pressure inside package 1 may be greater than approximately 20 psi. In some embodiments, the pressure inside package 1 may be greater than approximately one $CO_2$ gas volume. In some embodiments, the pressure inside package 1 may be greater than approximately 1.5 $CO_2$ gas volumes. In some examples, the package 1 may not be pressurized but could be pressurized. In another example, package 1 may be used without contents in product-storage region.

Gradual removal of lid 20 from container 10, such as may be provided with use of the aforementioned threaded configuration, may allow for gradual release of pressure and equalization of pressure. Gradual equalization of pressure may discourage lid 20 from being forced off container 10 suddenly (i.e. popping off). Furthermore, inclusion of one or more thread breaks 26*b*, 31*b* may facilitate venting and gradual pressure release during opening. Lid collar 30 may optionally include a bottom ring 33 for any of a variety of reasons, including, but not limited to, providing a lower bound for the downward movement of lid 20 relative to lid collar 30, and/or protecting lid 20 from being accidentally bumped or removed by some external force.

Package 1 and/or container 10 may have a substantially circular or cylindrical shape. If lid collar 30 is included and it and container 10 are substantially circular, this configuration may allow lid collar 30 to spin relative to container 10. Such free rotation could make it more difficult to open package 1 as an attempt to unscrew lid 20 from lid collar 30 could potentially result in free spinning of lid collar 30 and a lack of the necessary rotation of lid 20 relative to lid collar 30 for removing lid 20 as desired. Lid collar 30 is coupled to container 10 so as to minimize free spinning of closure 12 relative to container 10. Friction fit, adhesion, bonding, or the like, or any other suitable option may be used to block free spinning. In one example, container 10 and lid collar both include a non-circular portion which limits free spinning between container 10 and closure 12.

Figure 6:
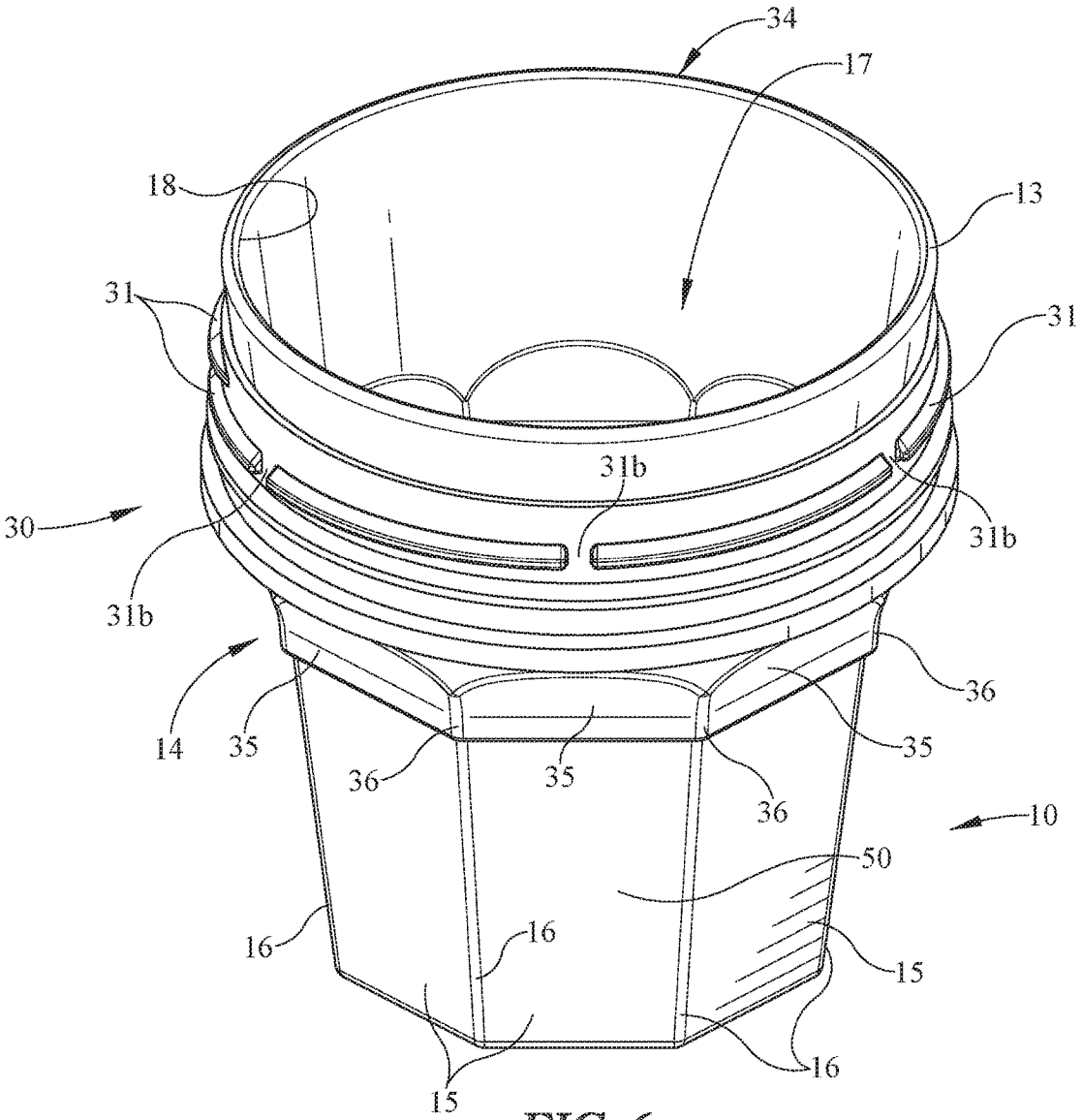
FIG. 6 is a perspective view of an opened container including the container and the lid collar showing that a removable lid included in the closure has been removed from the lid collar and the container leaving the lid collar and the container.

A lower portion or some portion below container rim 13 of container 10 may be substantially octagonal, with a series of container facets 15 separated by corners 16 as shown in FIG. 6. If container 10 is shaped in this way, lid collar 30 may have a similar shape and/or series of collar facets 35 and/or corners 36 for engaging and/or mating with container facets 15 of container 10. While the exemplary embodiment shown includes corresponding series of facets 15, 35 and corners 16, 36 forming a substantially octagonal portion in container 10 and lid collar 30 with eight container facets 15 and eight collar facets 35, respectively, any of a variety of shapes may be formed instead of or in addition to the octagon shown. For example, a series of six container facets 15 in container 10 and/or collar facets 35 in lid collar 30 may be included to form substantially hexagonal components. Moreover, while substantially flat or planar container facets 15 and/or collar facets 35 may be included, other non-round configurations may be used instead of or in addition to facets 15, 35. For example, container 10 and/or lid collar 30 may be substantially oval in shape, with non-uniform radii to minimize spinning of lid collar 30 relative to lid 20.

One or more facets 15, 35 may be included in no particular shape such as the aforementioned hexagon or octagon. For example, container 10 may include several container facets 15 separated by areas of one or more circular arcs so that some portions of container 10 are circular but other areas are not. In such embodiments the non-circular portions may be enough to sufficiently resist rotation of lid collar 30 relative to container 10. Container 10 and/or lid collar 30 may include one or more facets 15, 35 separated by a substantially circular or cylindrical region so that there is more circular than non-circular region, for example. Moreover, there may be a different number of container facets 15 than collar facets 35. While the embodiments shown in the various figures depict eight collar facets 35 and eight container facets 15, the number of each could vary.

In one example, choosing numbers arbitrarily to demonstrate the variability, container 10 may have four container facets 15 and lid collar 30 may have six collar facets 35. Continuing this example, collar facets 35 and container facets 15 may still be configured to block relative rotation even if of varying size, shape, and/or orientation. Any or all facets 15, 35, whether on container 10 or lid collar 30 or both, may vary from any other facet 15, 35, and no two facets need to be the same although they may be. As mentioned above, non-circular regions are not required and/or relative rotation of lid collar 30 relative to container 10 may be overcome in others ways instead of or in addition to use of non-circular regions.

Package 1 and/or any component thereof may have any suitable shape and, where shown in the figures as substantially circular such as in the case of lid 20, lid collar 30, and container rim 13, for example, is not limited to a substantially circular or cylindrical shape shown in the various figures.

Package 1 and/or any component thereof may be made of any of a variety of materials, including, but not limited to, any of a variety of suitable plastics material, any other material, or any combination thereof. Suitable plastics material may include, but is not limited to, polypropylene (PP), polystyrene (PS), polyethylene (PE), high-density polyethylene (HDPE), low-density polyethylene (LDPE), linear low-density polyethylene (LLDPE), polyethylene terephthalate (PET), crystallized polyethylene terephthalate (CPET), mixtures and combinations thereof, or any other plastics material or any mixtures and combinations thereof. Multiple layers of material may be used for any of a variety of reasons, including to improve barrier properties, to reduce weight and/or lightweight, or to provide known functions related to multiple layer structures. The multiple layers, if included, may be of various materials, including those recited herein.

Package 1 may be substantially rigid, substantially flexible, a hybrid of rigid and flexible, or any combination of rigid, flexible, and/or hybrid, such as having some areas be flexible and some rigid. A variety of processes or combination thereof may be used to form package 1, any component thereof, or any layer or substrate used therein. For example, any component, layer, or substrate, or combination thereof, may be thermoformed, injection molded, blow molded, coextruded, subjected to any other suitable process, or subjected to any combination thereof. In some embodiments, package 1 and/or any component thereof may be formed substantially of injection molded PP. In some embodiments, package 1 and/or any component thereof may be formed substantially of injection molded HDPE.

It may be desirable to use disposable packaging for containers or packages. For example, it may be desirable to purchase or obtain a package or container from a store while on the go, which may contain any of a variety of things, such as a beverage. A consumer may then drink the beverage and dispose of the container with minimal inconvenience.

One general approach to provide a disposable container has been to include a can or a bottle that is relatively inexpensive and disposable. However, to some consumers, there may be drawbacks to bottles and cans. Some consumers prefer a consuming experience more like drinking from a glass bottle, cup, glass, tumbler, or the like. This preference may exist in general, and/or in particular with higher end products, beverage or otherwise. However, with existing containers or packages, it is difficult to achieve these and other goals.

A package 1 comprises a container 10 and a closure 12 as shown in FIG. 1. Container 10 is formed to include a product-storage region 17 and a mouth 18 arranged to open into the product-storage region 17. Closure 12 configured to mate with the container 10 and establish a closed arrangement of the package 1. The closure 12 is further configured to be separated from the package 1 at the option of a user to establish an opened arrangement.

The closure 12 includes a lid collar 30 and a lid 20 as shown in FIG. 1. The lid collar 30 is arranged to extend around and surround a top portion of the container 10 and is coupled to the lid collar 30 in a fixed position relative to the lid collar 30 when the package 1 is in the closed arrangement. The lid 20 is rotatable about a longitudinal axis 19 of the container 10 relative to the lid collar 30 to cause the lid 20 to change and provide the opened arrangement of the package 1. The lid collar 30 is movable along the longitudinal axis 19 relative to the container 10 when the lid 20 is in the opened arrangement so to leave the container 10 spaced-apart from the lid collar 30 and the lid 20.

The lid collar 30 includes a bottom ring 33, a container mount 14 coupled to the bottom ring 33, and a lid mount 34 coupled to the bottom ring 33 as shown in FIG. 5. The container mount 14 is arranged to extend downwardly away from the lid 20 to engage with the container 10. The lid mount 34 is arranged to extend upwardly toward and mate with the lid 20 to retain the lid 20 on the lid mount 34 thereby closing the mouth 18 when the package 1 is in the closed arrangement. The container mount 14 is further configured to minimize rotation of the lid collar 30 relative to the container 10 when the lid 20 is rotated about the longitudinal axis 19.

The container mount 14 includes a collar facet 35 and a corner 16 as shown in FIGS. 6 and 7. The container includes a container facet 15 as shown FIGS. 6 and 7. The collar facet 35 has a relatively flat straight surface arranged to face toward the container 10. The container facet 15 has a straight relatively flat surface arranged to face toward and engage the relatively flat straight surface of the collar facet 35 when the package 1 is in the closed arrangement; this engagement causes rotational movement of the lid collar 30 relative to the container 10 to be blocked. The relatively flat straight surface of the collar facet 35 slides along the relatively flat straight surface of the container facet 15 when the lid collar 30 travels along the longitudinal axis 19 away from the mouth 18 of the container 10 when the package 1 is in the opened arrangement.

The lid collar 30 includes a bottom ring 33, a container mount 14 coupled to the bottom ring 33, and a lid mount 34 coupled to the bottom ring 33 as shown in FIG. 5. The container mount 14 is arranged to extend downwardly away from the lid 20 to engage with the container 10 so to minimize the rotation of the lid collar 30 relative to the container 10 when the lid 20 is rotated about the longitudinal axis 19. The lid mount 34 is arranged to extend upwardly toward and mate with the lid 20 so to retain the lid 20 on the lid mount 34 thereby closing the mouth 18 when the package 1 is in the closed arrangement. The container mount 14 includes a plurality of eight collar facets 35 that cooperate together to establish an octagon shape of the container mount 14 when viewed from the bottom. Each of the collar facets 35 has a relatively flat straight surface 48 arranged to face toward and engage the container 10.

The container 10 further includes a container facet 15 which has a straight relatively flat surface 50 as shown in FIG. 6. The container facet 15 is arranged to face toward and engage one of the eight relatively flat straight surfaces 48 of the collar facets 35 when the package 1 is in the closed arrangement so to cause rotational movement of the lid collar 30 relative to the container 10 to be blocked.

When the package 1 is in the closed arrangement, a pressure in the product-storage region is less than about 200 pounds per square inch. In other embodiments, when the package 1 is in the closed arrangement a pressure in the product-storage region is less than about 100 pounds per square inch. In some embodiments, when the package 1 is in the closed arrangement a pressure in the product-storage region is less than about 50 pounds per square inch. In other embodiments, a pressure in the product-storage region 17 is in a range of about 20 pounds per square inch to about 50 pounds per square inch. In additional embodiments, a pressure in the product-storage region 17 is in a range of about 20 pounds per square inch to about 100 pounds per square inch when the package 1 is in the closed arrangement.

The container 10 further includes a plurality of eight container facets 15 that cooperate together to establish an octagon shape of a portion of the container 10 as shown in FIG. 1. Each of the container facets 15 have a straight relatively flat surface 50 arranged to face toward and engage an associated one of the eight relatively flat straight surfaces 48 of the collar facets 35 when the package 1 is in the closed arrangement to cause rotational movement of the lid collar 30 relative to the container 10 to be blocked.

The lid 20 further includes a cap 37, a lid thread 26 coupled to the cap 37, and a band 24 coupled to the cap 37 as shown in FIG. 4. The cap 37 of lid 20 is arranged to cover the mouth 18 of the container 10 when the package 1 is in the closed arrangement. The lid thread 26 is arranged to extend toward the lid collar 30 to mate with a collar thread 31 included in the lid collar 30. The band 24 is arranged to extend downwardly away from the cap 37.

The band 24 includes a retention ring 38, a weakened ring 39, and a ring retainer 41 coupled to the retention ring 38 as shown in FIG. 4. The retention ring 38 is located in spaced-apart relation to the cap 37. The weakened ring 39 is arranged to extend between and interconnect the retention ring 38 and the cap 37. The ring retainer 41 is arranged to extend upwardly toward the collar thread 31 and engage the collar thread 31 to cause the weakened ring 39 to fracture in response to the rotation of the cap 37 relative to the container 10. The retention ring 38 and the ring retainer 41 remain coupled to the lid collar 30 once the cap 37 is separated from the lid collar 30 and the package 1 is in the opened arrangement. Furthermore, in some embodiments, a pressure in the product-storage region 17 is in a range of about 20 pounds per square inch to about 100 pounds per square inch when the package 1 is in the closed arrangement.

The lid collar 30 includes a bottom ring 33, a container mount coupled to the bottom ring 33, and a lid mount coupled to the bottom ring 33 as shown in FIG. 5. The container mount 14 is arranged to extend downwardly away from the lid 20 to engage with the container 10. The lid mount 34 is arranged to extend upwardly toward and mate with the lid 20 to retain the lid 20 on the lid mount 34 thereby closing the mouth 18 when the package 1 is in the closed arrangement.

The lid 20 includes a cap 37, a lid thread 26 coupled to the cap 37, and a band 24 coupled to the cap 37 as shown in FIG. 4. The cap 37 is arranged to cover the mouth 18 of the container 10 when the package 1 is in the closed arrangement. The lid thread 26 is arranged to extend toward the lid collar 30 to mate with a collar thread 31 included in the lid collar 30. The band 24 is arranged to extend downwardly away from the cap 37.

The band 24 includes a retention ring 38, a weakened ring 39, and a ring retainer 14 coupled to the retention ring 38 as shown in FIG. 4. The retention ring 38 is spaced-apart from the cap 37. The weakened ring 39 is arranged to extend between and interconnect the retention ring 38 and the cap 37. The ring retainer 14 is arranged to extend upwardly toward the collar thread 31 and engage the collar thread 31 thereby causing the weakened ring 39 to fracture in response to the rotation of the cap 37 relative to the container 10. When the weakened ring 39 is fractured, the retention ring 38 and the ring retainer 14 remain coupled to the lid collar 30 once the cap 37 is separated from the lid collar 30 and the package 1 is in the opened arrangement.

The lid collar 30 includes a bottom ring 33, a container mount 14 coupled to the bottom ring 33, and a lid mount 34 coupled to the bottom ring 33 as shown in FIG. 5. The container mount 14 is arranged to extend downwardly away from the lid 20 thereby engaging with the container 10 to minimize the rotation of the lid collar 30 relative to the container 10 when the lid 20 is rotated about the longitudinal axis 19. The lid mount 34 is arranged to extend upwardly toward and mate with the lid 20 thereby retaining the lid 20 on the lid mount 34 and closing the mouth 18 when the package 1 is in the closed arrangement.

The container mount 14 includes a collar facet 35 as shown in FIG. 5. The collar facet 35 has a relatively flat straight surface 48 arranged to face toward the container 10. The container 10 includes a container facet 15. The container facet 15 has a straight relatively flat surface 50 arranged to face toward and engage the relatively flat straight 48 surface of the collar facet 35 when the package 1 is in the closed arrangement to cause rotational movement of the lid collar 30 relative to the container 10 to be blocked.

The relatively flat straight surface 48 of the collar facet 35 slides along the relatively flat straight surface 50 of the container facet 15 when the lid collar 30 travels along the longitudinal axis 19 away from the mouth 18 of the container 10 when the package 1 is in the opened arrangement as suggested in FIG. 6.

The container mount 14 includes a plurality of eight collar facets 35 that cooperate together to establish an octagon shape of the container mount 14 when viewed from the bottom as suggested in FIG. 6. Each of the collar facets 35 has a relatively flat straight surface 48 arranged to face toward and engage the container 10.

The container 10 includes a container facet 15 as shown in FIG. 6. The container facet 15 has a straight relatively flat surface 50 arranged to face toward and engage one of the eight relatively flat straight surfaces 48 of the collar facets 35 when the package 1 is in the closed arrangement thereby causing rotational movement of the lid collar 30 relative to the container 10 to be blocked. In some embodiments, a pressure in the product-storage region 17 is in a range of about 20 pounds per square inch to about 100 pounds per square inch when the package 1 is in the closed arrangement.

The container 10 includes a plurality of eight container facets 15 that cooperate together to establish an octagon shape of a portion of the container 10 as suggested in FIGS. 1 and 6. Each of the container facets 15 have a straight relatively flat surface 50 arranged to face toward and engage an associated one of the eight relatively flat straight surfaces 48 of the collar facets 35 when the package 1 is in the closed arrangement to cause rotational movement of the lid collar 30 relative to the container 10 to be blocked.

In some embodiments, portions of lid collar 30 may be substantially tapered, angled, and/or wedge shaped as suggested in FIGS. 5 and 6. In one example, portions of container 10 may also be substantially tapered, angled, and/or wedge shaped so as to cooperate with lid collar 30 and limit upward movement of lid collar 30 relative to container 10. An outer surface of facet 35 may angle outwardly from a center or central axis of lid collar 30. An opposite inner surface of facet 35 may angle inwardly toward the center or central axis of lid collar 30. The inner surface may be shaped to substantially mate and/or engage the outside surface of container wall 11 in a flush manner. Portions of lid collar 30 may be held in place on container wall 11 by a friction fit, adhesion, bonding, or any other suitable mechanism.

The invention claimed is:

1. A package comprising a container formed to include a product-storage region and a mouth arranged to open into the product-storage region and a closure configured to mate with the container and establish a closed arrangement of the package and to be separated from the package at the option of a user to establish an opened arrangement, wherein the closure includes a lid collar and a lid and the lid collar is arranged to extend around and surround a top portion of the container and the lid is coupled to the lid collar in a fixed position relative to the lid collar when the package is in the closed arrangement, the lid is separable from the lid collar to provide the opened arrangement of the package, wherein the lid collar is movable along the longitudinal axis relative to the container when the lid is in the opened arrangement so as to leave the container spaced-apart from the lid collar and the lid, wherein the lid includes a cap arranged to cover the mouth of the container when the package is in the closed arrangement, a lid thread coupled to the cap and arranged to extend toward the lid collar to mate with a collar thread included in the lid collar, and wherein at least one of the lid thread and the collar thread includes at least one thread break configured to facilitate venting and gradual pressure release when the package transitions from the closed arrangement to the opened arrangement.

2. The package of claim 1, wherein the container includes a side wall having at least a portion arranged to taper outwardly at an angle from the longitudinal axis and the lid collar includes an inner surface arranged to face toward and mate with the portion of the side wall to establish a friction fit between the lid collar and the container when the package in the closed arrangement.

3. The package of claim 2, wherein upward movement of the lid collar relative to the container is limited by engagement of the inner surface of the lid collar with the portion of the side wall and the inner surface of the lid collar moves away from the portion of the side wall in response to downward movement of the lid collar relative to the container.

4. The package of claim 3, wherein the lid includes a cap arranged to cover the mouth of the container when the package is in the closed arrangement and a lid thread coupled to the cap and arranged to extend toward the lid collar to mate with a collar thread included in the lid collar and the lid collar includes a bottom ring, a container mount coupled to the bottom ring and arranged to extend downwardly away from the lid to engage with the container to minimize rotation of the lid collar relative to the container when the lid is rotated about the longitudinal axis.

5. The package of claim 4, wherein the container mount includes a collar facet which has a relatively flat straight surface arranged to face toward the container and configured to taper inwardly toward the container and the longitudinal axis and the container includes a container facet configured to provide the portion of the side wall.

6. The package of claim 1, wherein the lid collar includes a bottom ring, a container mount coupled to the bottom ring and arranged to extend downwardly away from the lid to engage with the container, and a lid mount coupled to the bottom ring and arranged to extend upwardly toward and mate with the lid to retain the lid on the lid mount closing the mouth when the package is in the closed arrangement.

7. The package of claim 6, wherein the container mount is configured to minimize rotation of the lid collar relative to the container when the lid is rotated about the longitudinal axis.

8. The package of claim 7, wherein the lid mount includes a collar facet which has a relatively flat straight surface arranged to face toward the container and the container includes a container facet which has a straight relatively flat surface arranged to face toward and engage the relatively flat straight surface of the collar facet when the package is in the closed arrangement to cause rotational movement of the lid collar relative to the container to be blocked.

9. The package of claim 8, wherein the relatively flat straight surface of the collar facet slides along the relatively flat straight surface of the container facet when the lid collar translates along the longitudinal axis away from the mouth of the container when the package is in the opened arrangement.

10. The package of claim 1, wherein the lid collar includes a bottom ring, a container mount coupled to the bottom ring and arranged to extend downwardly away from the lid to engage with the container to minimize rotation of the lid collar relative to the container when the lid is rotated about the longitudinal axis, and a lid mount coupled to the bottom ring and arranged to extend upwardly toward and mate with the lid to retain the lid on the lid mount closing the mouth when the package is in the closed arrangement and the container mount includes a plurality of collar facets and each of the collar facets has a relatively flat straight surface arranged to face toward and engage the container.

11. The package of claim 10, wherein the container includes at least one container facet which has a straight relatively flat surface arranged to face toward and engage one of the relatively flat straight surfaces of the collar facets when the package is in the closed arrangement to cause rotational movement of the lid collar relative to the container to be blocked.

12. The package of claim 11, wherein a pressure in the product-storage region is in a range of 20 pounds per square inch to 50 pounds per square inch.

13. The package of claim 11, wherein a pressure in the product-storage region is in a range of 20 pounds per square inch to 200 pounds per square inch when the package is in the closed arrangement.

14. The package of claim 10, wherein the container includes a plurality of container facets and each of the container facets has a straight relatively flat surface arranged to face toward and engage an associated one of the relatively flat straight surfaces of the collar facets when the package is in the closed arrangement to cause rotational movement of the lid collar relative to the container to be blocked.

15. The package of claim 1, wherein the lid includes a cap arranged to cover the mouth of the container when the package is in the closed arrangement, a lid thread coupled to the cap and arranged to extend toward the lid collar to mate with a collar thread included in the lid collar, and a band coupled to the cap and arranged to extend downwardly away from the cap.

16. The package of claim 15, wherein the band includes a retention ring located in spaced-apart relation to the cap, a weakened ring arranged to extend between and interconnect the retention ring and the cap, and a ring retainer coupled to the retention ring and arranged to extend upwardly toward the collar thread and engage the collar thread to cause the weakened ring to fracture in response to rotation of the cap relative to the container so that the retention ring and the ring retainer remain coupled to the lid collar once the cap is separated from the lid collar and the package is in the opened arrangement.

17. The package of claim 16, wherein the lid collar includes a bottom ring, a container mount coupled to the bottom ring and arranged to extend downwardly away from the lid to engage with the container, and a lid mount coupled to the bottom ring and arranged to extend upwardly toward and mate with the lid to retain the lid on the lid mount closing the mouth when the package is in the closed arrangement.

18. The package of claim 1, wherein the lid includes a cap arranged to cover the mouth of the container when the package is in the closed arrangement, a lid thread coupled to the cap and arranged to extend toward the lid collar to mate with a collar thread included in the lid collar, and a band coupled to the cap and arranged to extend downwardly away from the cap, the band includes a retention ring located in spaced-apart relation to the cap, a weakened ring arranged to extend between and interconnect retention ring and the cap, and a ring retainer coupled to the retention ring and arranged to extend upwardly toward the collar thread and engage the collar thread to cause the weakened ring to fracture in in response to rotation of the cap relative to the container so that the retention ring and the ring retainer remain coupled to the lid collar once the cap is separated from the lid collar and the package is in the opened arrangement, wherein the lid collar includes a bottom ring, a container mount coupled to the bottom ring and arranged to extend downwardly away from the lid to engage with the container to minimize rotation of the lid collar relative to the container when the lid is rotated about the longitudinal axis, and a lid mount coupled to the bottom ring and arranged to extend upwardly toward and mate with the lid to retain the lid on the lid mount closing the mouth when the package is in the closed arrangement.

19. The package of claim 18, wherein the container mount includes at least one collar facet which has a relatively flat straight surface arranged to face toward the container and the container includes at least one container facet which has a straight relatively flat surface arranged to face toward and engage the relatively flat straight surface of the at least one collar facet when the package is in the closed arrangement to cause rotational movement of the lid collar relative to the container to be blocked, wherein the relatively flat straight surface of the at least one collar facet slides along the relatively flat straight surface of the at least one container facet when the lid collar translates along the longitudinal axis away from the mouth of the container when the package is in the opened arrangement, and wherein the at least one collar facet includes a plurality of collar facets and the at least one container facet includes a plurality of container facets that cooperate together to establish an octagon shape of a portion of the container and each of the container facets has a straight relatively flat surface arranged to face toward and engage an associated one of the relatively flat straight surfaces of the collar facets when the package is in the closed arrangement to cause rotational movement of the lid collar relative to the container to be blocked.

20. A package comprising a container formed to include a product-storage region and a mouth arranged to open into the product-storage region and a closure configured to mate with the container and establish a closed arrangement of the package and to be separated from the package at the option of a user to establish an opened arrangement, wherein the closure includes a lid collar and a lid and the lid collar is arranged to extend around and surround a top portion of the container and the lid is coupled to the lid collar in a fixed position relative to the lid collar when the package is in the closed arrangement, the lid is rotatable about a longitudinal axis of the container relative the lid collar to cause the lid to change and provide the opened arrangement of the package, wherein the lid collar is movable along the longitudinal axis relative to the container when the lid is in the opened arrangement so as to leave the container spaced-apart from the lid collar and the lid, and wherein a pressure in the product-storage region is less than 200 pounds per square inch.

* * * * *